US005793278A

United States Patent [19]

Pohl et al.

[11] Patent Number: 5,793,278

[45] Date of Patent: Aug. 11, 1998

[54] LIMITER FOR CURRENT LIMITING

[75] Inventors: Fritz Pohl, Hemhofen; Wilfried Jaehner, Nuremberg, both of Germany

[73] Assignee: Siemens Aktiengesellschaft, Munchen, Germany

[21] Appl. No.: 605,224

[22] PCT Filed: Aug. 26, 1994

[86] PCT No.: PCT/DE94/00986

§ 371 Date: Jun. 17, 1996

§ 102(e) Date: Jun. 17, 1996

[87] PCT Pub. No.: WO95/07540

PCT Pub. Date: Mar. 16, 1995

[30] Foreign Application Priority Data

Sep. 9, 1993 [DE] Germany ..... 43 30 607.1

[51] Int. Cl.[6] ..... H01C 7/10

[52] U.S. Cl. ..... 338/32 R

[58] Field of Search ..... 338/22 R, 225 D, 338/99, 104, 112, 114

[56] References Cited

U.S. PATENT DOCUMENTS

| | | | |
|---|---|---|---|
| 2,785,316 | 10/1957 | Kingsbury | 250/214 R |
| 3,243,753 | 3/1966 | Kohler | 338/22 R |
| 3,835,434 | 9/1974 | Kahn . | |
| 4,377,541 | 3/1983 | Bobik . | |
| 4,426,339 | 1/1984 | Kamath et al. | 264/450 |
| 4,482,801 | 11/1984 | Habata et al. | 338/22 R |
| 4,833,305 | 5/1989 | Mashimo et al. | 219/549 |
| 4,959,632 | 9/1990 | Uchida | 338/22 R |
| 5,379,022 | 1/1995 | Bacon et al. | 338/20 |
| 5,382,938 | 1/1995 | Hansson et al. | 338/22 R |

FOREIGN PATENT DOCUMENTS

| | | | |
|---|---|---|---|
| A 0 223 404 | 5/1987 | European Pat. Off. . | |
| 0 487 920 A1 | 6/1992 | European Pat. Off. . | |
| A 37 07 494 | 3/1988 | Germany . | |
| 4228297 | 3/1994 | Germany | 338/22 R |
| WO 91/12643 | 8/1991 | WIPO . | |

*Primary Examiner*—Teresa J. Walberg
*Assistant Examiner*—Karl Easthom
*Attorney, Agent, or Firm*—Kenyon & Kenyon

[57] ABSTRACT

A current limiter with a controllable resistance which assumes a low value during rated service and a high value during a short-circuit disconnect. The current limiter includes a thermoplastic resistive member between two flat, metallic electrodes. Each of the flat metallic electrodes has a surface profile on the side facing the thermoplastic resistive member. The resistive member has a surface profile complementary to the surface profile on the adjacent surfaces of the flat electrodes. The flat electrodes and the resistive member are thereby inseparably connected, with the flat electrodes and the resistive member being pressed together by a pressure force. The interlocking of the surfaces results in an especially rapid readjustment of the limiter resistance from its high-resistance state during a short-circuit disconnect back to the low-resistance state during rated service.

13 Claims, 4 Drawing Sheets

I [kA]
U [kV]
U [V]
t
ms
51
52
53
54
0.0
0.5
1.0
1.5
2.0
2.5
3.0
3.5

LIMITER FOR CURRENT LIMITING

FIELD OF THE INVENTION

The present invention relates to a limiter for current limiting which changes from a low resistance to a high resistance when an overload occurs. More specifically, the present invention relates to a current limiter having a thermoplastic resistive member and flat, metal electrodes.

BACKGROUND INFORMATION

Low-voltage circuit-breakers are often connected in series with so-called limiters in order to significantly increase the short-circuit switching capacity in low-voltage electrical networks and to significantly limit the cut-off currents. Such limiters are designed to transition rapidly, in case of a short circuit, from a low-resistance state to a high-resistance state and contribute with their voltage requirement to rapid current limiting and disconnection.

For use as a central limiter, which is connected ahead of multiple branches in order to provide short-circuit protection to the branches, it especially would be desirable to have the limiter function go into effect only for high short-circuit currents, which, for example, circuit-breakers present in the branches cannot handle, and to have no limiter function for moderate or decaying short-circuit currents. This would prevent undesired, longer lasting voltage interruptions which could lead to uncontrolled circuit states, e.g., in contactors or relays.

Switching devices with a simple electromechanical design are commonly used as limiters. The contacts of such devices open dynamically due to electrodynamic forces and such devices normally have no latching mechanism and no triggering system. Their arc-drop voltage plateau lies in the range of the line voltage amplitude. Together with the arc-drop voltage of the circuit-breaker connected in series, the short-circuit current is brought to a rapid decay and the disconnection time is shortened. Electric arc limiters with this design have problems with contact welding, which can be managed in technical terms only with special contact materials and/or with a special contact mechanism.

PCT International Application WO-A-91/12643 and European Patent Application EP-A-0 487 920 describe limiters which take advantage of the PTC (positive temperature coefficient) effect. In these devices, high-current resistors are used which consist essentially of a polyethylene layer filled with carbon black which exhibits the PTC effect. In such a high-current resistor usable as a protective element, the polymer resistive member should be connected with its surface areas to electrodes in order to guarantee the PTC effect. A pressure device is present which exerts a pressure perpendicularly on the electrodes and the surface areas of the resistive member of the conductive polymer layer.

Moreover, German Published Patent Application DE-A-37 07 494 describes a resistive component having two metal electrodes between which a material having PTC characteristics is arranged in which a roughening of the electrode surfaces is created by electrolytic deposition. Here, irregular peaks from 0.5 μm to 500 μm can exist. In the method of operation of such a PTC element, a permanent, unchanging connection of the electrode surfaces to the PTC material is presupposed in order to realize constant resistance values of the component as a function of temperature.

Finally, U.S. Pat. No. 4,377,541 describes a method for manufacturing varistors from polycrystalline metal oxide for low-voltage applications in which a molding press is used in which the press matrices have projections with a regular structure. Thus, in the powder-metallurgical manufacture, a profile is introduced into the varistor disk in order to achieve a low breakdown voltage. Such varistors should be suited particularly to applications at low power levels with low currents and low voltages, a non-linearity of the electrical conductivity of the metal oxide being taken advantage of. The non-linearity of the varistor material is based on its semiconductor characteristics and is distinguished fundamentally from the pattern of the electrical characteristics of the PTC material of limiters suited to high currents, which consists of a mixture of non-conductive support material, such as polyethylene, and an electrically conductive material, such as carbon black.

The physical basis of the limiters mentioned above is that in case of a short circuit, the temperature rises through ohmic heating beyond the crystallization temperature of the polyethylene as the electrically insulating base material, causing microscopic conducting paths of the carbon black, as the electrically conductive material component, to break up and the limiter resistance to increase by a factor of 100 or more. The resistance of such limiters can be determined primarily through the volume resistance of the PTC material.

In accordance with its switching principle, in the known limiters, the surface resistance on the boundary surfaces between the polymer resistive member and the electrodes contributes significantly to the current-limiting effect in case of a short-circuit. Since the electrodes and the polymer resistive member contact one another only by touching through the external pressure force, the heating of the PTC material takes place in a thin layer close to the surface, which switches in case of a short circuit very quickly from a low-resistance to a high-resistance state.

Once the short circuit is disconnected, such a boundary layer limiter requires a readjustment time of typically about 20 ms for the decay of the high electrical resistance to the low starting value. In practice, a parallel resistor is connected to relieve the PTC element, the parallel resistor carrying the predominant share of the short-circuit current in the high-resistance state of the PTC material. During the disconnection time of the circuit-breaker connected in series, the decaying short-circuit current produces a considerable voltage drop across the parallel resistor. This can take on a value of 100 V or more and exist for a time duration of 3 ms and longer. For use as a central limiter, however, a switching voltage which lasts so long is disadvantageous since correspondingly long voltage interruptions would be caused otherwise in branches of the electrical network which are not disrupted in themselves.

SUMMARY OF THE INVENTION

An object of the present invention is to provide a limiter which can also be used as a central limiter. Functioning as a central limiter, it is to be expected that voltage interruptions caused by the limiter's switching voltage remain limited to a fraction of a half-cycle duration, e.g., to a time duration $t<1$ ms.

This objective is solved by the limiter in accordance with the present invention which includes metal flat electrodes having a regular surface profile on their sides facing a thermoplastic resistive member in which profile joint faces run to some extent parallel to the plane of the flat electrode, the thermoplastic resistive member having a complementary surface profile on its sides facing the metal flat electrodes, the flat electrodes and the resistive member being inseparably connected mechanically, the flat electrodes and the resistive member being pressed together by a pressure force which has different effects depending on the orientation of the profile joint faces, so that when an overload occurs, a gas discharge arises between the contact-making profile joint faces of the flat electrodes and the resistive member, particularly on the profile joint faces running parallel to the plane of the flat electrode, and when the overload decays, the contact making takes place, at least momentarily, exclusively via the profile joint faces which do not run parallel to the plane of the flat electrode.

Insofar as the circuit-breakers connected in the current branches in series with the central limiter have a sufficiently high switching speed for high short-circuit currents, it can be achieved advantageously with the present invention that, after the limiter voltage decays, the switch-off procedure is continued without delay with a sufficiently high arc-drop voltage. The function of a limiter voltage which is activated only for high instantaneous currents is thus achieved through a boundary-layer limiter in which a partial friction-locked contacting of the electrodes on the resistive member occurs, even in the case of a short circuit. As characteristic feature of such a limiter, the electrodes and the resistive member have a positive or rather negative, i.e., complementary surface profile with which they adhere solidly to one another mechanically.

In order to realize the limiter according to the present invention, the thermoplastic resistive member, which, for example, is in the form of a rectangular sheet, is pressed between profiled electrodes and heated to its softening temperature at least at the contact surfaces. The resistive material flows into the profile depressions of the metal electrodes and a complementary surface profile of the resistive member arises. Following this procedure, the electrodes adhere solidly to the resistive member from which they can be reseparated only by mechanically damaging the profiled layers.

As with the prior art, the adhesion to the profiled surfaces between the electrodes and the resistive member is not sufficient to obtain a low limiter resistance. In order to achieve the low rated resistance of the limiter defined for rated service, the flat electrodes are pressed against the resistive member with a pressure force typically between 50 and 100 N/cm$^2$.

FIGS. **4*a* and 4*b*** show resistance curves for a prior art limiter and a limiter in accordance with the present invention, respectively.

Figure 1:
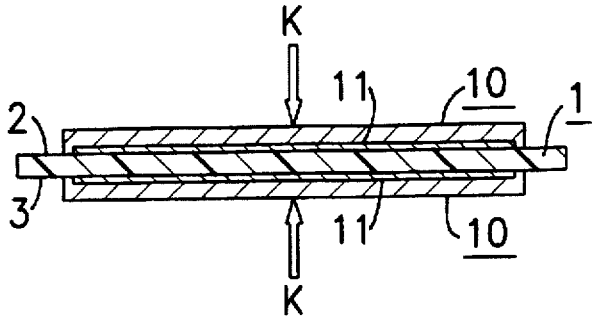
FIG. 1 shows a cross-sectional view of a limiter in accordance with the present invention.
Figure 2:
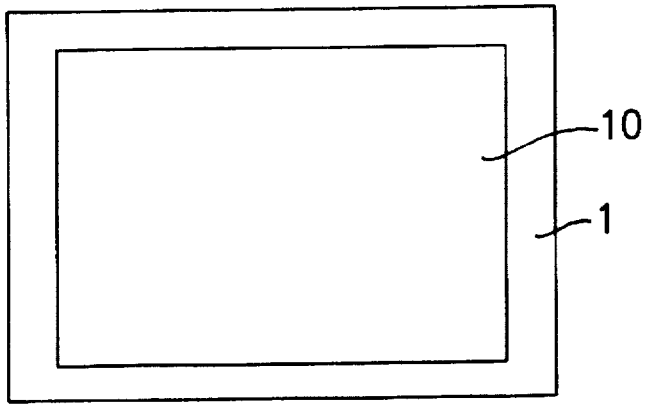
FIG. 2 shows a top view of the limiter according to FIG. 1.

FIGS. **5*a* through 5*d* illustrate the voltage and current characteristics of a short-circuit disconnection of a series circuit using the limiter according to FIGS. 1 to 3**.

FIGS. **6*a* through 6*d* show he switching phases of a limiter according to FIGS. 1 to 3**.

DETAILED DESCRIPTION

As shown in FIGS. 1 and 2, a thermoplastic resistive member 1 having surfaces 2 and 3 is pressed together between two flat electrodes 10 of the same kind. A pressure force K is applied for this purpose. An arrangement of this general sort is known in principle from German Patent Application No. P 42 28 297.7.

Figure 3A:
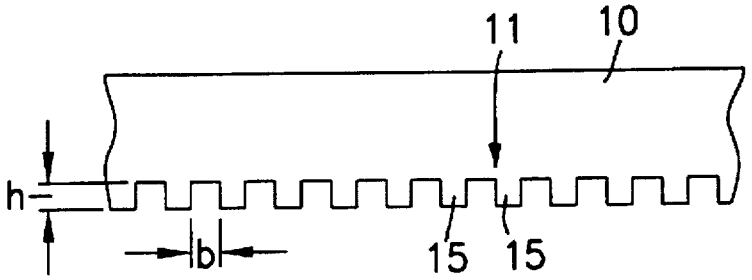
FIGS. 3A and 3B shows the construction of a flat electrode of a limiter in accordance with the present invention.

As shown in FIG. 3A, both flat electrodes 10 have a profiling 15 which has, for example, a rectangular structure with a segment width b and a segment height h. The segment width b can range between 0.1 and 1 mm and the segment height likewise between 0.1 and 1 mm. In particular, the segment width b and segment height h are on the same order of magnitude, preferably between 0.3 and 0.6 mm. In the exemplary embodiment illustrated in FIG. 3, each dimension is approximately 0.4 mm.

The resistive member 1 has a complementary profiling 5 on both surfaces 2 and 3. The resistive member 1 and the flat electrodes are connected inseparably via the profilings 5 and 15.

Figure 3B:
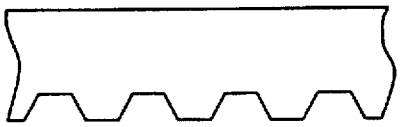

As seen in FIG. 3B the rectangular profile can be modified to have a slope angle with respect to the surface of the flat electrode 10. The surface profile 15 can advantageously have a sectionally different direction. A conical form of the surface profile 15 is also possible.

The limiter described herein is connected ahead of a circuit-breaker in a known manner. A resistive element is connected in parallel to the limiter consisting of the resistive member 1 and the flat electrodes 10. The resistive element can be, for example, an ohmic resistance with a value of 100 mΩ. It can also be a non-linear, voltage-dependent resistance whose resistance decreases with the applied voltage. In both cases, the current can commutate at the proper point in time.

FIG. **4*b* shows the behavior over time of the limiter resistance for a short-circuit disconnection at $I_k$=40 kA, with a series connection of a circuit-breaker and the limiter according to FIGS. 1 through 3, which has a constant resistance of 100 mΩ connected in parallel to it. The limiter resistance according to graph 42** begins to climb slightly with the start-up of the short-circuit current from its initial value $R_0$=4 mΩ and after about 300 μs reaches an initial plateau value of about 8 mΩ. While the short-circuit current continues to climb, reaching a value of 5 kA 500 μs after the start of the short circuit, the resistance curve goes into a steep climb at this point in time and for about 300 μs remains at resistance values which are significantly greater than 100 mΩ. About 900 μs after the start of the short circuit, the limiter resistance returns to a low-resistance value of about 15 mΩ and finally drops back to its initial value.

For the sake of comparison, the progression over time of the limiter resistance according to the prior art is shown as graph 41 in FIG. **4*a***.

Figure 4A:
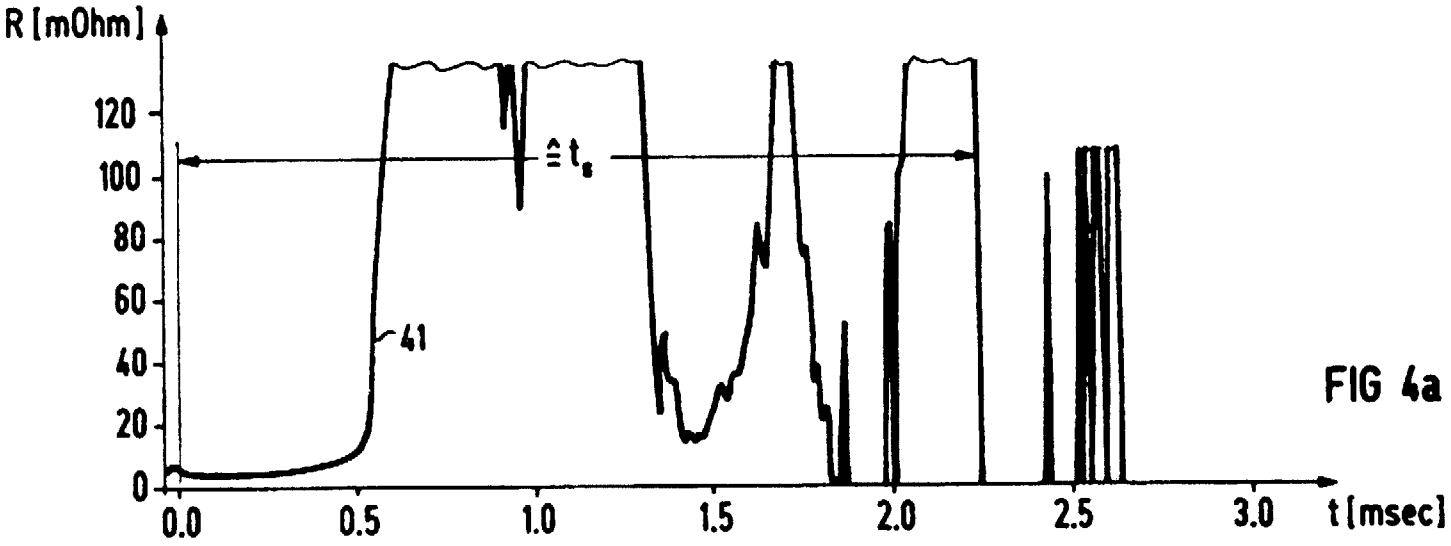
Figure 4B:
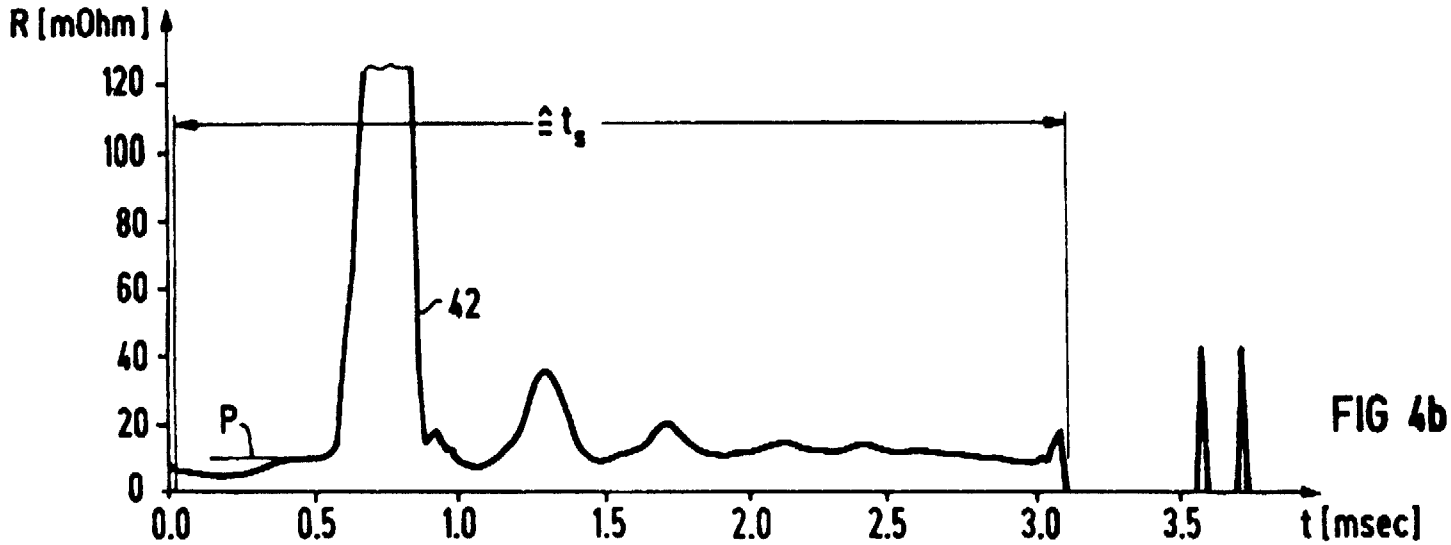
Figures 5A, 5B, 5C, 5D:
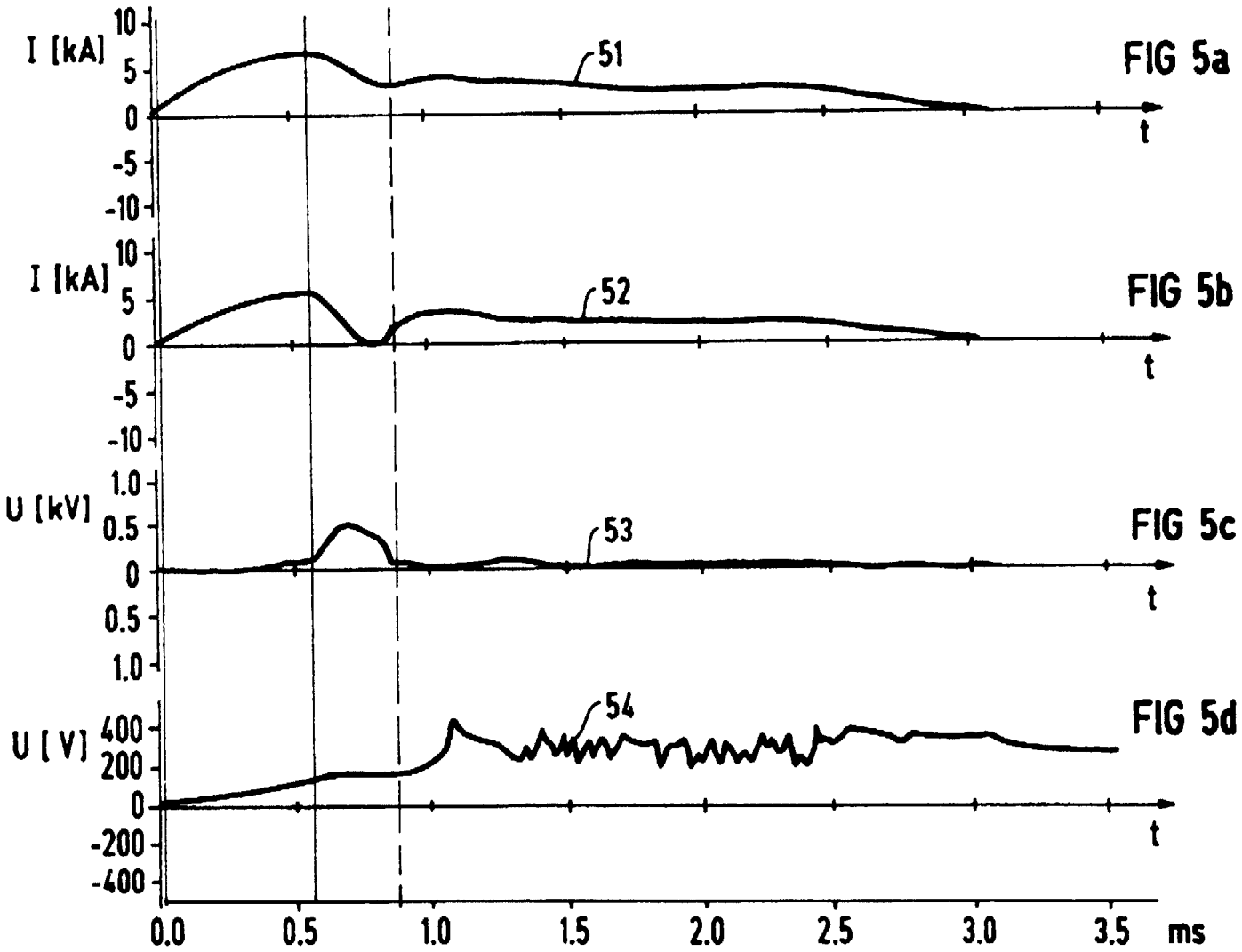

In the current/voltage oscillogram according to FIG. 5, graph 51 represents the overall current, graph 52 the PTC current, graph 53 the associated PTC voltage and graph 54 the voltage on the switching device used. The resistance behavior described in connection with FIG. 4 manifests itself such that the limiter generates a voltage pulse of approximately 450 V and of approximately 300 μs duration about 600 μs after the start of the short circuit. In this phase, the short-circuit current drops from its maximum value $i_{max}$=6.7 kA to about 3 kA, an increasing share of the current being carried by the parallel resistor (100 mΩ). After the decay of its voltage pulse, the limiter carries the reduced short-circuit current, which is caused by the partial electrical/mechanical contact of the flat electrodes on the resistive member. A repeated increase in current is prevented by the sufficiently high arc-drop voltage of the circuit-breaker at this point in time and the short circuit is disconnected after an overall duration of 3 ms.

The switching characteristics of the limiter described with reference to FIGS. 1 to 3 and the accompanying measuring curves according to FIGS. 4 and 5 can be explained in phenomenological terms with reference to FIGS. 6*a* through 6*d*. In the initial state of the limiter according to FIG. 6*a*, the pressure force K applied perpendicularly to the flat electrodes provides a friction-locked contacting of the profile joint faces running perpendicularly to the pressure force. In contrast, the action of force between the profile joint faces 12 running parallel to the pressure force is significantly less since after the thermal production process the profile layer of the thermoplastic resistive material undergoes a dimensional contraction of 1 to 2% due to the very much higher thermal expansion coefficient with respect to metals.

Figure 6A:
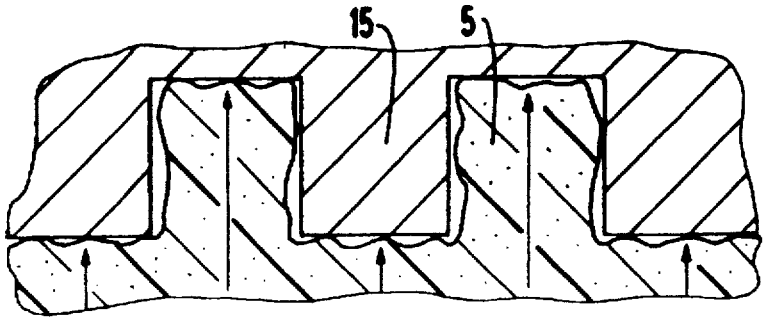
Figure 6B:
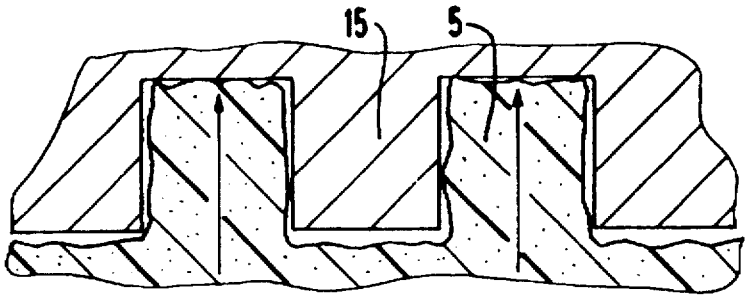
Figure 6C:
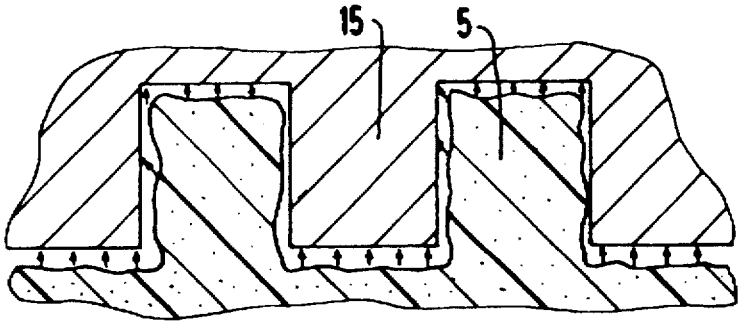

In the case of the short-circuit disconnection presented in FIGS. 4 and 5, an increasing heating commences with the start of the current rise due to the electrical power loss in the boundary layer. Associated with the heating is an expansion of the profile layer 5 of the resistive member 1 with a considerable reduction of the electrical contact surface, as shown in FIG. 6*b*. Through thermal expansion of the thermoplastic profile segments, the metal electrodes 10 are raised from the recessed profile joint faces of the resistive member 1. A momentary limiter resistance appears, which is characterized by the first plateau value shown in FIG. 4*b*. Simultaneously, the current density on the profile end faces of the resistive member 1 approximately doubles and the electrical power loss leads to the rapid heating to the breakdown temperature of the resistive material. As a result, the mechanical/electrical contact is largely interrupted also on these profile joint faces, as shown in FIG. 6*c*, and a distributed electrical discharge with high arc voltage forms between the profile surfaces.

Figure 6D:
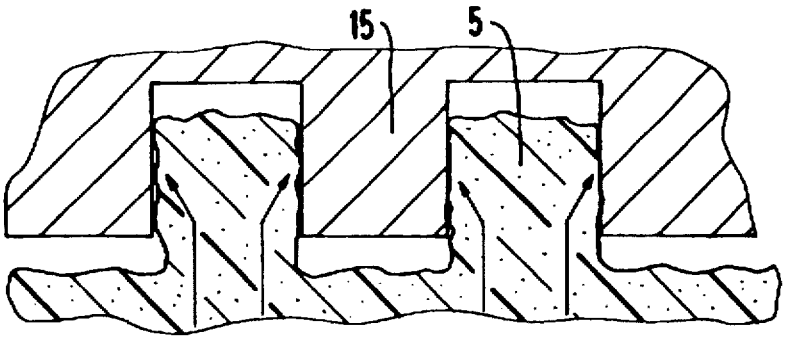

During the phase of high limiter voltage, the profile layer 5 is further heated up and material broken down to some extent, with a considerable gas pressure building up as a result. With the reduction of the gas pressure due to the decaying short-circuit current and due to the thermal expansion of the thermoplastic profile segments, contact surfaces form, as shown in FIG. 6*d*, between the profile joint faces 12 of the electrodes 10 running parallel to the pressure force and the resistive member 1. The effective contact force between the contact surfaces increases as the temperature and thermal expansion of the resistive material increase, thus leading to the observed low limiter resistance of about 15 mΩ at the end of the limiter voltage pulse. This process is supported by the fact that the parallel resistor of the limiter briefly takes on the entire current and thus ends the material breakdown on the resistive member 1.

During the cooling time of the thermoplastic resistive member 1 of up to several 100 ms, the surface profile of the resistive member 1 is shaped under the action of force of the profiled metal electrodes 10 which are pressed by the pressure force K and the limiter resistance returns to its initial value.

With respect to the arrangements known from the prior art, it is thus important in the limiter of the present invention that no free contact surfaces exist, but rather that the flat electrodes and the resistive member are connected inseparably by way of their complementary surface profiles.

We claim:

1. A current limiter with a resistance which changes from a low value to a high value when an overload occurs, the current limiter comprising:

a thermoplastic resistive member; and flat metallic electrodes arranged adjacent to opposite surfaces of the thermoplastic resistive member, wherein:

each of the flat metallic electrodes includes a regular surface profile on a surface facing the thermoplastic resistive member, the surface profile including joint faces which are parallel to the surface facing the thermoplastic resistive member and joint faces which are at an angle to the surface facing the thermoplastic resistive member, the thermoplastic resistive member includes a complementary surface profile on each of its opposite surfaces facing the flat electrodes, the flat electrodes and the resistive member are connected mechanically at their respective regular and complementary surface profiles, and the flat electrodes and the resistive member are pressed together by a pressure force, whereby:

when an overload occurs, a gas discharge arises between the joint faces of the flat electrodes and of the resistive member, particularly between the joint faces that are parallel to the surfaces of the flat electrodes, and when the overload decays, contacting takes place, at least momentarily, exclusively via the joint faces which are at an angle to the surfaces of the flat electrodes.

2. The current limiter according to claim 1, wherein the complementary surface profiles of the surfaces of the resistive member are formed by thermal premolding on the flat metallic electrodes.

3. The current limiter according to claim 1, wherein the surface profile and the complementary surface profile include a plurality of rectangular structures, each of the rectangular structures having a width and a height.

4. The current limiter according to claim 3, wherein the width and the height of each of the rectangular structures lie between 0.1 mm and 1 mm.

5. The current limiter according to claim 3, wherein a width and a height of the rectangular structures lie between 0.3 mm and 0.6 mm.

6. The current limiter according to claim 1, wherein the surface profile and complementary surface profile include a plurality of structures with sloping faces.

7. The current limiter according to claim 1, wherein the surface profile includes a plurality of structures having a substantially conical shape.

8. The current limiter according to claim 1, wherein the resistive member includes thermoplastic material having a conductive material component.

9. The current limiter according to claim 8, wherein the thermoplastic material is polyethylene and the conductive material component is graphite.

10. The current limiter according to claim 1, wherein the flat electrodes include electrically and thermally conductive material.

11. The current limiter according to claim 1, further including a resistive element coupled in parallel with the thermoplastic resistive member and the flat electrodes.

12. The limiter according to claim 11, wherein the resistive element is an ohmic resistance.

13. The limiter according to claim 11, wherein the resistive element is a non-linear, voltage-dependent resistance whose value decreases with an applied voltage.

* * * * *